US010919124B2

(12) United States Patent
Armborst et al.

(10) Patent No.: US 10,919,124 B2
(45) Date of Patent: Feb. 16, 2021

(54) GRINDING MACHINE

(71) Applicants: KAPP Werkzeugmaschinen GmbH, Coburg (DE); NILES Werkzeugmaschinen GmbH, Berlin (DE)

(72) Inventors: Holger Armborst, Sonneberg (DE); Stefan Kramer, Lautertal (DE)

(73) Assignees: KAPP WERKZEUGMASCHINEN GMBH, Coburg (DE); NILES WERKZEUGMASCHINEN GMBH, Berlin (DE)

( * ) Notice: Subject to any disclaimer, the term of this patent is extended or adjusted under 35 U.S.C. 154(b) by 333 days.

(21) Appl. No.: 15/967,957

(22) Filed: May 1, 2018

(65) Prior Publication Data

US 2018/0318981 A1 Nov. 8, 2018

(30) Foreign Application Priority Data

May 2, 2017 (DE) ..... 10 2017 004 237

(51) Int. Cl.
*B24B 47/10* (2006.01)
*B24B 47/12* (2006.01)

(52) U.S. Cl.
CPC ..... *B24B 47/12* (2013.01); *B24B 47/10* (2013.01)

(58) Field of Classification Search
CPC ..... B24B 47/10; B24B 47/12; B24B 23/06
USPC ..... 451/294, 344, 353, 358
See application file for complete search history.

(56) References Cited

U.S. PATENT DOCUMENTS 2,693,066 A * 11/1954 Berstecher ..... B24B 5/38 451/24
3,082,580 A * 3/1963 Lonaberger ..... B24B 27/0015 451/21
3,094,816 A * 6/1963 Dreier ..... B23Q 1/5481 451/213

(Continued)

FOREIGN PATENT DOCUMENTS

DE 620052 A 10/1935
DE 1752500 B 7/1971

(Continued)

OTHER PUBLICATIONS

Office Action dated Sep. 28, 2018 from corresponding European Application No. EP 18168887.0.

*Primary Examiner* — Eileen P Morgan
(74) *Attorney, Agent, or Firm* — Lucas & Mercanti, LLP; Klaus P. Stoffel

(57) ABSTRACT

A grinding machine including an electric drive with a drive wheel, wherein the electric drive is arranged on a base unit of the grinding machine, a grinding spindle unit constructed as a grinding arm arranged removable on the base unit and which includes a grinding tool and a gear element which transmits the rotational movement of the drive wheel to the grinding tool. To facilitate the change of the grinding arm, the gear element includes: a driver which is supported on the grinding spindle unit and which is directly or indirectly in rotary union with the grinding tool, two guide wheels which are supported on the grinding spindle unit and a belt which is guided around the driver and the guide wheels, wherein in the mounted state of the grinding spindle unit at the base unit the drive wheel contacts the belt between the two guide wheels and hereby drives the same.

10 Claims, 2 Drawing Sheets

(56) References Cited

U.S. PATENT DOCUMENTS

| | | | | | |
|---|---|---|---|---|---|
| 3,848,362 | A * | 11/1974 | Kikuchi | B24B 7/16 | 451/159 |
| 3,929,038 | A * | 12/1975 | Moser | B24B 47/12 | 74/810.1 |
| 4,083,152 | A | 4/1978 | Lorenz | | |
| 4,125,968 | A * | 11/1978 | Mackey | B24B 23/026 | 451/295 |
| 5,065,546 | A | 11/1991 | Lorenz | | |
| 6,602,120 | B2 * | 8/2003 | Bavelloni | B24B 9/102 | 144/103 |
| 6,679,962 | B2 * | 1/2004 | Kurose | F16G 5/20 | 156/137 |
| 8,366,517 | B2 * | 2/2013 | Weder | A47L 11/4069 | 451/353 |
| 8,870,631 | B2 * | 10/2014 | Tai | B24B 7/186 | 451/271 |
| 10,427,271 | B2 * | 10/2019 | Bluhme | B24B 47/12 | |
| 2002/0034927 | A1 * | 3/2002 | Bavelloni | B24B 41/04 | 451/236 |
| 2011/0081847 | A1 * | 4/2011 | Yang | B24B 47/12 | 451/359 |
| 2011/0136417 | A1 * | 6/2011 | Weder | B24B 7/186 | 451/353 |
| 2011/0136418 | A1 * | 6/2011 | Weder | B24B 7/186 | 451/353 |
| 2015/0183076 | A1 * | 7/2015 | Lange | B24B 5/24 | 451/11 |
| 2018/0318980 | A1 * | 11/2018 | Kramer | B24B 41/04 | |
| 2018/0318981 | A1 * | 11/2018 | Armborst | B24B 47/12 | |

FOREIGN PATENT DOCUMENTS

| | | | |
|---|---|---|---|
| DE | 2552259 | A1 | 6/1977 |
| DE | 19936652 | A1 | 2/2001 |
| DE | 102004043397 | A1 | 3/2006 |
| EP | 0416151 | B1 | 3/1991 |
| EP | 2036668 | A1 | 3/2009 |
| GB | 575276 | A | 2/1946 |

* cited by examiner

GRINDING MACHINE

CROSS-REFERENCE TO RELATED APPLICATIONS

The present application claims priority of DE 10 2017 004 237.3, filed May 2, 2017, the priority of this application is hereby claimed and this application is incorporated herein by reference.

BACKGROUND OF THE INVENTION

The invention relates to a grinding machine comprising an electric drive with a drive wheel, wherein the electric drive is arranged on a base unit of the grinding machine, a grinding spindle unit which is arranged removable on at the base unit of the grinding machine and which comprises a grinding tool and a gear element which transmits the rotational movement of the drive wheel to the grinding tool.

It is known for special grinding tasks to provide a grinding machine with special grinding spindle units especially in the form of grinding arms. This is specifically relevant for the grinding of workpieces with inner profiles. Such a grinding arm is described for example in EP 0 416 151 B1. The tubular arm is here driven at one of its axial ends by means of a driving shaft, wherein a pinion is driven around which a toothed belt runs. At the other axial end of the arm a further shaft is arranged which also carries a pinion around which the toothed belt runs. The grinding spindle is then driven via this shaft. The grinding arm is fixed at a reception of the grinding machine at its end remote from the grinding wheel.

A grinding machine according to the generic kind is also shown in GB 575 276 A, in DE 25 52 259 A1 and in DE 620 052 A. DE 17 52 500 B shows a drive for a surface grinding machine by means of a belt.

Normally, such a grinding arm does not comprise its own drive; rather for the drive of the grinding wheel a drive is used which is existent in the grinding machine. However, a driving belt must be mounted then at the mounting of the grinding arm to the base unit of the grinding machine.

The driving belt is threaded manually after screwing of the grinding spindle unit to the base unit. After its complete assembly the tension in the belt must be adjusted which is time-consuming and in addition requires a special know how.

Thereby, it is necessary due to economical reasons to execute a change of the grinding arm as quick as possible to keep the dead time of the machine low. On the other hand a very precise positioning of the grinding arm on the grinding machine and thus in the reception for the grinding arm has a significant importance to be able to machine the workpiece precisely.

Accordingly, at the pre-known solution the relative long assembly time and the required know-how are detrimental to carry out a change of the grinding spindle unit, especially of a grinding arm.

SUMMARY OF THE INVENTION

It is an object of the invention to further develop a grinding machine of the generic kind so that it becomes possible to facilitate the change of the grinding spindle unit, especially of a grinding arm. So, the setup times should be optimized which are necessary for the arrangement of the grinding spindle unit on the base unit of the grinding machine. Furthermore, the comfort for the machine operator should be enhanced. Potential sources of errors at the assembly of the grinding spindle unit should be eliminated.

The solution of this object by the invention is characterized in that the gear element comprises: a driver which is supported in the grinding spindle unit and which is directly or indirectly in rotary union with the grinding tool, two guide wheels which are supported on the grinding spindle unit and a belt which is guided around the driver and the guide wheels, wherein in the mounted state of the grinding spindle unit to the base unit the drive wheel contacts the belt between the two guide wheels and hereby drives the same.

The belt is thereby preferably designed as a toothed belt which is provided with a profile at its inner side as well as at its outer side (thus both-sided). The drive wheel, the driver and the two guide wheels are preferably designed as wheels for a toothed belt.

One of the two guide wheels is preferably fixedly supported on the grinding spindle unit, while the other of the two guide wheels is supported on the grinding spindle unit preferably elastically displaceable in the direction perpendicular to its axis of rotation. In this case it is preferably provided that a limitation of displacement is arranged for the displacement of the elastically displaceable guide wheel. The limitation of displacement for the elastically displaceable guide wheel is thereby preferably chosen in such a manner that a predetermined tension is given in the belt in the mounted state of the grinding spindle unit to the base unit of the grinding machine. I. e. a certain desired tension in the belt is obtained quasi automatically at the contact of the grinding spindle unit with the base unit.

The drive wheel has preferably contact with the belt along a peripheral angle of at least 30° in the mounted state of the grinding spindle unit to the base unit of the grinding machine.

The grinding spindle unit and the base unit of the grinding machine each respectively comprise preferably a contact area at which they butt against another in the mounted state, wherein on one of the contact areas at least two clamp pins being spaced apart from another are arranged, wherein in the other of the contact areas two corresponding recesses are arranged for the reception of the clamp pins, wherein locking means are arranged by which the clamp pins can be locked in the recesses so that the grinding spindle unit is fixed detachably in a defined position relative to the base unit. Correspondingly designed so-called zero-point clamping systems, which are known as such, allow a quick coupling of the grinding spindle unit to the base unit as well as an easy releasing of the same.

In the grinding spindle unit and in the base unit detachable coupling means can be provided for the transmission of a fluid under pressure and/or detachable contact means for the transmission of electricity or of electrical signals. Here it is especially considered that the coupling means are designed for the transmission of oil, cooling lubricant or oil mist. With the detachable contact means for the transmission of electricity or of electrical signals an electrical connection between the grinding spindle unit and the grinding machine can be established in an easy manner which is important for example for the survey of the system.

The grinding spindle unit is preferably designed as a grinding arm or auxiliary spindle.

Dressable grinding wheels as well as such with a steel base body which is coated with abrasive material can be used.

By the proposed design it is possible to carry out the assembly and setup respectively of the grinding spindle unit at the base unit of the grinding machine very quick and easy as well as with only low sources of errors.

A connection of the different parts, especially concerning the belt drive, becomes redundant. This applies as well for an elaborate threading of the toothed belt at the assembly of the grinding spindle unit to the base unit.

It is also very beneficial that the adjustment of the proper pre-tension of the belt becomes redundant; rather the proper pre-tension results automatically at the coupling of the grinding spindle unit to the base unit.

Furthermore, the proposed construction allows that after the disassembly of the grinding spindle unit from the base unit of the grinding machine it is made sure that the belt remains securely connected with the grinding spindle unit at shutdown due to the elastic displaceable arrangement of one of the guide wheels.

Moreover, a quick change of the grinding spindle unit with high repeat accuracy is possible by the use of the described zero-point clamping system.

Thus, an optimization of the setup time at the setup of the grinding machine with a grinding spindle unit, especially with a grinding arm, is possible, wherein additionally a high position repeat accuracy can be obtained.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
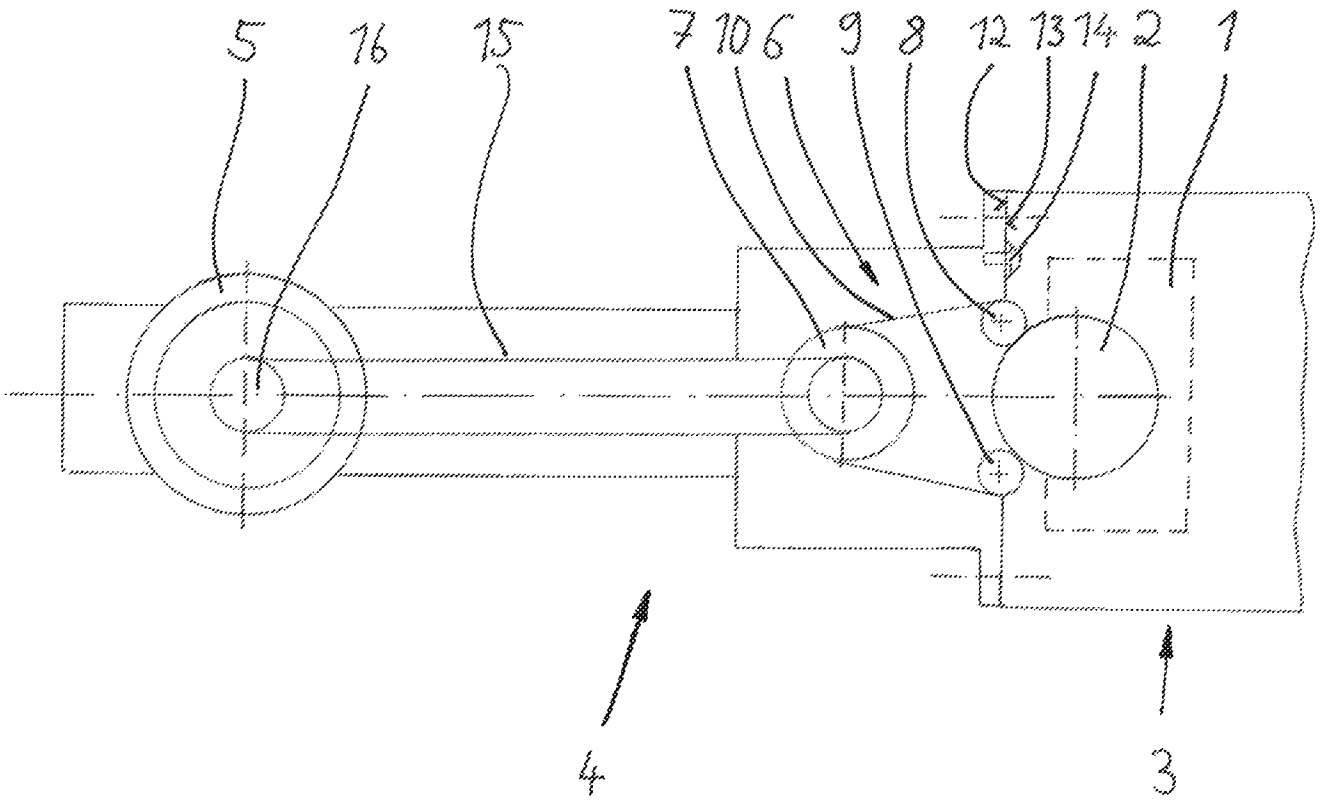
FIG. 1 shows schematically a grinding spindle unit in the form of a grinding arm, wherein the grinding spindle unit is fixed and coupled respectively to a base unit of a grinding machine.

In FIG. 1 a part of a grinding machine for grinding of gears or profiles is indicated, wherein a base unit 3 of the grinding machine can be seen to which a grinding spindle unit 4 in the form of a grinding arm is mounted to grind, for example, an internal toothing.

The grinding arm 4 is designed in sections as a tubular structure, wherein in the interior of the tubular structure a driving belt 15 drives a shaft 16 which carries a grinding tool 5, presently in the form of a grinding wheel. In the axial end region, which is opposite to the grinding tool 5, a driver 7 is arranged; accordingly, the driver 7 and the shaft 16 form two spaced bearing zones for the driving belt 15.

In the base unit 3, an electric drive 1 is arranged which comprises a drive wheel 2. The driving torque of the drive wheel 2 is transmitted by a gear element 6 to the grinding tool 5.

The grinding arm 4 is detachably coupled to the base unit 3. At the coupling of the parts 3 and 4 the contact areas 13 and 14 get in contact. A precise and secure coupling of the parts 3 and 4 occurs via a zero-point clamping system, which comprises especially clamp pins 14 which enter into recesses in the opposite part and are clamped here by means of a clamping device. Zero-point clamping systems of this kind are well known as such in the state of the art and need not to be described in more detail here.

In order that the coupling of the grinding arm 4 to the base unit 3 can occur quickly and reliably and thereby a secure transmission of the torque from the drive wheel 2 to the grinding wheel 5 is guaranteed, it is provided that the gear element 6 comprises at first the driver 7 which is supported in the grinding spindle unit 4 which is in rotary connection with the grinding tool 5 directly or indirectly—presently indirectly via the driving belt. Furthermore, two guide wheels 8 and 9 are provided which are supported in the grinding spindle unit 4, namely a first guide wheel 8 and a second guide wheel 9. A belt 10 is guided around the driver 7, the first guide wheel 8 and the second guide wheel 9, and is designed as toothed belt which has a profile on both sides. As can be seen from FIG. 1 the drive wheel 2 contacts the belt 10 between the first guide wheel 8 and the second guide wheel 9 in the mounted state of the grinding spindle unit 4 to the base unit 3. Thereby a transmission of the torque takes place from the drive wheel 2 to the grinding wheel 5 via the belt 10.

Figure 3:
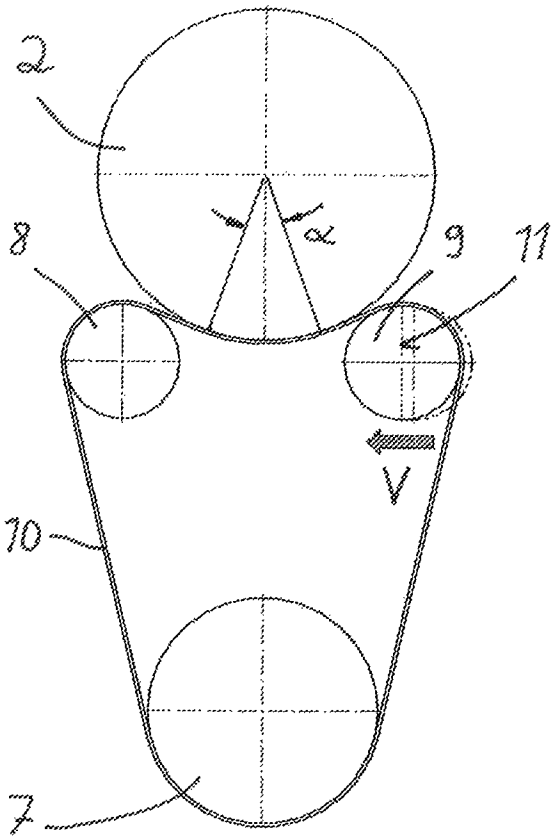
FIG. 3 shows how the drive wheel tensions the belt in the depiction of FIG. 2, in the coupled state between the grinding spindle unit and the base unit.
Figure 2:
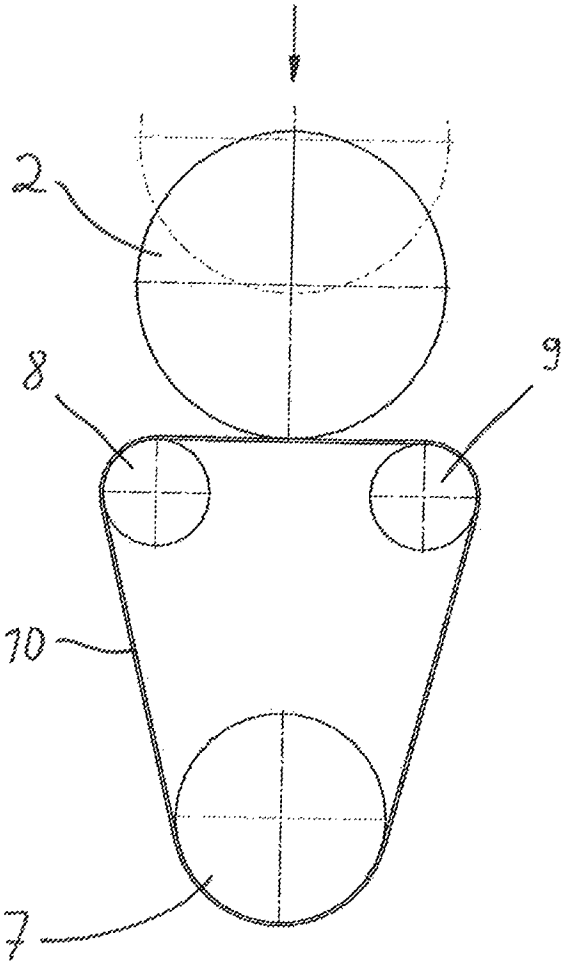
FIG. 2 shows a part of a gear element for the transmission of the rotational movement of a drive wheel to a grinding wheel, wherein here the state is shown in which the grinding spindle unit is not yet coupled with the base unit.

The process of coupling of the grinding spindle unit 4 at the base unit 3 is again depicted in FIGS. 2 and 3 in more detail; thereby FIG. 2 shows the not yet coupled state while FIG. 3 illustrates the complete coupled state.

When the parts 4 and 3 are coupled by contacting the contact areas 12 and 13, the drive wheel 2 is moved relative to the unit consisting of driver 7, first guide wheel 8 and second guide wheel 9, which is illustrated by the arrow in FIG. 2. Accordingly, the drive wheel 2 approaches the grinding spindle unit including the components 7, 8, 9, which is also indicated by the dotted position of the drive wheel 2.

When the contact areas 12 and 13 are contacting another the relative position of the mentioned parts is reached as can be seen from FIG. 3 (and FIG. 1).

Accordingly, the drive wheel 2 is pressed against the belt 10 between the first guide wheel 8 and the second guide wheel 9. While the first guide wheel 8 is supported stiff and not displaceable respectively in the grinding spindle unit 4 this does not apply for the second guide wheel 9; this is elastically and resiliently movably respectively supported perpendicular to its axis of rotation (which is perpendicular to the plane of projection in all figures), which is indicated by the direction of displacement V in FIG. 3. However, this possibility of elastic displacement exists only up to a limitation for displacement 11 which defines the maximum value for the displacement of the second guide wheel 9 in direction V.

Thus, when the contact areas 12 and 13 adjoin the arrangement is given which is illustrated in FIG. 3. In this position the belt 10 winds around the drive wheel 2 by an angle $\alpha$ which is preferably at least 30°. Therefore, the required torque can reliably be transmitted. The belt 10 has thereby a defined pre-tension.

While specific embodiments of the invention have been shown and described in detail to illustrate the inventive principles, it will be understood that the invention may be embodied otherwise without departing from such principles.

We claim:

1. A gear or profile grinding machine comprising:

an electric drive with a drive wheel, wherein the electric drive is arranged on a base unit of the grinding machine and rotates the drive wheel, a grinding spindle unit which is configured as a grinding arm that has a tubular structure at least in sections, wherein the grinding arm is removably mounted to the base unit of the grinding machine so as to extend from the base unit, wherein the grinding arm extends longitudinally from end that includes a driver to an opposite end which comprises a grinding tool which is mounted on a shaft, wherein the driver is in rotary union with the grinding tool by a first belt which is guided around the driver at a first location and guided around the grinding tool shaft, and a gear element which transmits rotational movement of the drive wheel to the grinding tool, wherein the gear element comprises:

the driver which is supported on the grinding spindle unit and which is in rotary union with the grinding tool via the first belt, two guide wheels which are supported on the grinding spindle unit and a second belt which is guided around the driver at a second different location and the guide wheels, wherein in the mounted state of the grinding spindle unit at the base unit the drive wheel contacts the belt between the two guide wheels and thereby drives the driver via the second belt and, in turn, drives the grinding tool via the first belt.

2. The gear or profile grinding machine according to claim 1, wherein the belt second is a toothed belt which is provided with a profile at its inner side as well as at its outer side.

3. The gear or profile grinding machine according to claim 1, wherein the drive wheel, the driver and the two guide wheels are configured as wheels for toothed belts.

4. The gear or profile grinding machine according to claim 1, wherein one of the two guide wheels is fixedly supported in the grinding spindle unit and another one of the two guide wheels is supported in the grinding spindle unit displaceable in the direction perpendicular to its axis of rotation.

5. The gear or profile grinding machine according to claim 4, wherein a limitation of displacement is arranged for the displacement of the elastically displaceable guide wheel.

6. The gear or profile grinding machine according to claim 5, wherein the limitation of displacement for the elastically displaceable guide wheel is chosen so that the second belt has a predetermined tension in the mounted state of the grinding spindle unit at the base unit of the grinding machine.

7. The gear or profile grinding machine according to claim 1, wherein a periphery of the drive wheel has contact with the second belt over an angle of at least 30° in the mounted state of the grinding spindle unit at the base unit of the grinding machine.

8. The gear or profile grinding machine according to claim 1, wherein the grinding spindle unit and the base unit of the grinding machine each comprise a contact area at which they butt against one another in the mounted state, wherein at one of the contact areas at least two clamp pins being spaced apart from another are arranged, wherein at the other of the contact areas two corresponding recesses are arranged for the reception of the clamp pins, wherein locking means are arranged by which the clamp pins can be locked in the recesses so that the grinding spindle unit is fixed detachably in a defined position relatively to the base unit.

9. The gear or profile grinding machine according to claim 1, wherein the grinding spindle unit and the base unit include detachable coupling means for the transmission of a fluid under pressure.

10. The gear or profile grinding machine according to claim 1, wherein the grinding spindle unit and the base unit include detachable contact means for the transmission of electricity or of electrical signals.

* * * * *